US005410444A

United States Patent [19]

Juds

[11] Patent Number: 5,410,444

[45] Date of Patent: Apr. 25, 1995

[54] ELECTRONIC CONTROL SYSTEM FOR A LOCKED DRAWER

[75] Inventor: Scott Juds, Seattle, Wash.

[73] Assignee: IDX, Inc., El Dorado, Ark.

[21] Appl. No.: 967,028

[22] Filed: Oct. 27, 1992

[51] Int. Cl.[6] ..... H01H 47/22; E05B 47/02

[52] U.S. Cl. ..... 361/191; 361/171; 292/144; 70/282

[58] Field of Search ..... 361/191-193, 361/195-198, 170, 171, 172; 70/277, 280-282; 292/144; 312/333; 340/310 R, 310 A

[56] References Cited

U.S. PATENT DOCUMENTS

| | | | |
|---|---|---|---|
| 1,768,021 | 6/1930 | Bauerband . | |
| 1,986,840 | 1/1935 | Meilink . | |
| 2,872,006 | 2/1959 | Payne, Sr. et al. . | |
| 3,592,521 | 7/1971 | Cox . | |
| 3,795,417 | 3/1974 | Cohen . | |
| 3,979,054 | 9/1976 | Graham . | |
| 4,060,846 | 11/1977 | Conn | 361/193 |
| 4,083,424 | 4/1978 | von den Stemmen et al. X | 361/172 |
| 4,268,076 | 5/1981 | Itoi . | |
| 4,579,214 | 4/1986 | Volk . | |
| 4,866,963 | 9/1989 | Leininger et al. | 70/278 |
| 5,129,501 | 7/1992 | Halsey et al. . | |

FOREIGN PATENT DOCUMENTS 177176 3/1922 United Kingdom .

*Primary Examiner*—A. D. Pellinen
*Assistant Examiner*—Fritz M. Fleming
*Attorney, Agent, or Firm*—Diller, Ramik & Wight

[57] ABSTRACT

An electronic control system (10) for use in controllably unlocking a locked drawer. Portions of the system (10) are located in the vicinity (12) of the locked drawer and portions are located in a remote location ( 11 ). The system (10) includes an operator accessible switch (14) located in the remote location (11), which switch enables two separate, parallel, redundant unlocking mechanism paths. Each path includes a time delay unit (17) that delays the opening of the locked drawer until a predetermined period of time following activation of the system by the operator, in order to allow time for the operator to move from the remote location to the locked drawer. In addition to providing power to circuitry that unlocks the locked drawer, the system also provides from the remote location, and then decodes at the locked drawer location, an authorization signal. Without this signal, the unlocking circuitry will not unlock the drawer, even in the presence of power.

7 Claims, 4 Drawing Sheets

ELECTRONIC CONTROL SYSTEM FOR A LOCKED DRAWER

TECHNICAL FIELD

This invention relates generally to the field of locked drawers, and particularly to locked drawers having unlocking mechanisms that are electronically controlled.

BACKGROUND OF THE INVENTION

Locked drawers are used in a variety of applications, including unattended car washes. For example, an unattended car wash will typically have a coin (or token) reception slot and validation mechanism associated therewith to allow a user to enable the car washing mechanism itself. The coins (or tokens) are then typically deposited in a locked drawer. From time to time, an attendant: will visit the locked drawer, unlock it and open it, and remove the coins (or tokens) that have collected there. The drawer will then be reclosed and relocked until the next collection episode.

One particularly useful coin (token) collection system of this type is disclosed in U.S. Pat. No. 5,129,501, entitled Car Wash Coin/Token Collection System as filed by Halsey and Erwin and issued on Jul. 14, 1992 (the contents of which are incorporated herein by this reference). The system disclosed therein provides a secure lockable drawer that is held in a locked position by a pin, which pin falls into and remains in a locked position through the action of gravity. Solenoid coils are used to draw the pin into an unlocked position, to thereby allow the drawer to be opened and the coins (tokens) recovered.

Despite the many advantages of the system described in the above patent, the described system does not necessarily adequately meet all potential applications. For example, the mechanism that initiates the unlocking process is disclosed as being in close proximity to the locked drawer itself. This has occasional disadvantages in that the availability of the mechanism will tempt some thieves to tamper with the mechanism itself. Removing the mechanism to a remote location, however, poses other problems; in particular, the operator must activate the mechanism from the remote location, and by the time the operator makes his or her way to the now unlocked drawer, a thief may have already made easy unauthorized access to the drawer and removed the coins (tokens). Another problem involves the risks that the described system poses to the operator with respect to a breakdown within the unlocking system itself. Should both solenoid coils fail, or should the energizing circuit that supplies both coils fail, the drawer cannot be opened without necessitating likely destruction of the drawer itself and/or the wall that contains it. This, of course, constitutes a serious inconvenience and expense for the operator.

There therefore exists a need for a control system for such a locked drawer that avoids these and other problems. Preferably, such a solution should provide increased security with respect to unauthorized access, while simultaneously assuring the operator of increased reliability during usage.

SUMMARY OF THE INVENTION

These needs and others are substantially met through provision of the electronic control system described herein. The system has components that are segregated as between a first location and a second location, which locations are operationally remote from one another.

The electronic control system is used with a drawer that is located in the first location, and which drawer is lockable in a closed position by at least one pin disposed in a first position and that is unlocked by moving the pin to a second position. The electronic control system itself is comprised of a first and second electric coil, wherein each coil is independently capable of moving the at least one pin to the second position, and each is operably coupled to the at least one pin, for causing the at least one pin to move to the second position when energized. The system further includes a coil activation unit coupled to both the first and second electric coils for causing both coils to simultaneously become energized. At least a portion of the coil activation unit is located at the second location, and hence remote with respect to the locked drawer itself.

It is an object of the, invention that the electric coils not be energized until both a power signal is provided and an appropriate authorization signal.

It is another object of the invention that the electric coils not be energized until a, period of time has elapsed following initiation of the system by an operator, thereby providing the operator with time to move from the second to the first location, during which time the locked drawer remains locked and hence relatively immune to unauthorized access.

It is yet another object of the invention to provide an indication to the operator as to the operating integrity of the system itself, to allow repairs to be effected before serious problems develop regarding accessibility of the drawer.

BRIEF DESCRIPTION OF THE DRAWINGS

These and other attributes of the invention will become more clear upon making a thorough review and study of the following description of the preferred embodiment, particularly when studied in conjunction with the drawings, wherein.

DESCRIPTION OF A PREFERRED EMBODIMENT

Figure 1:
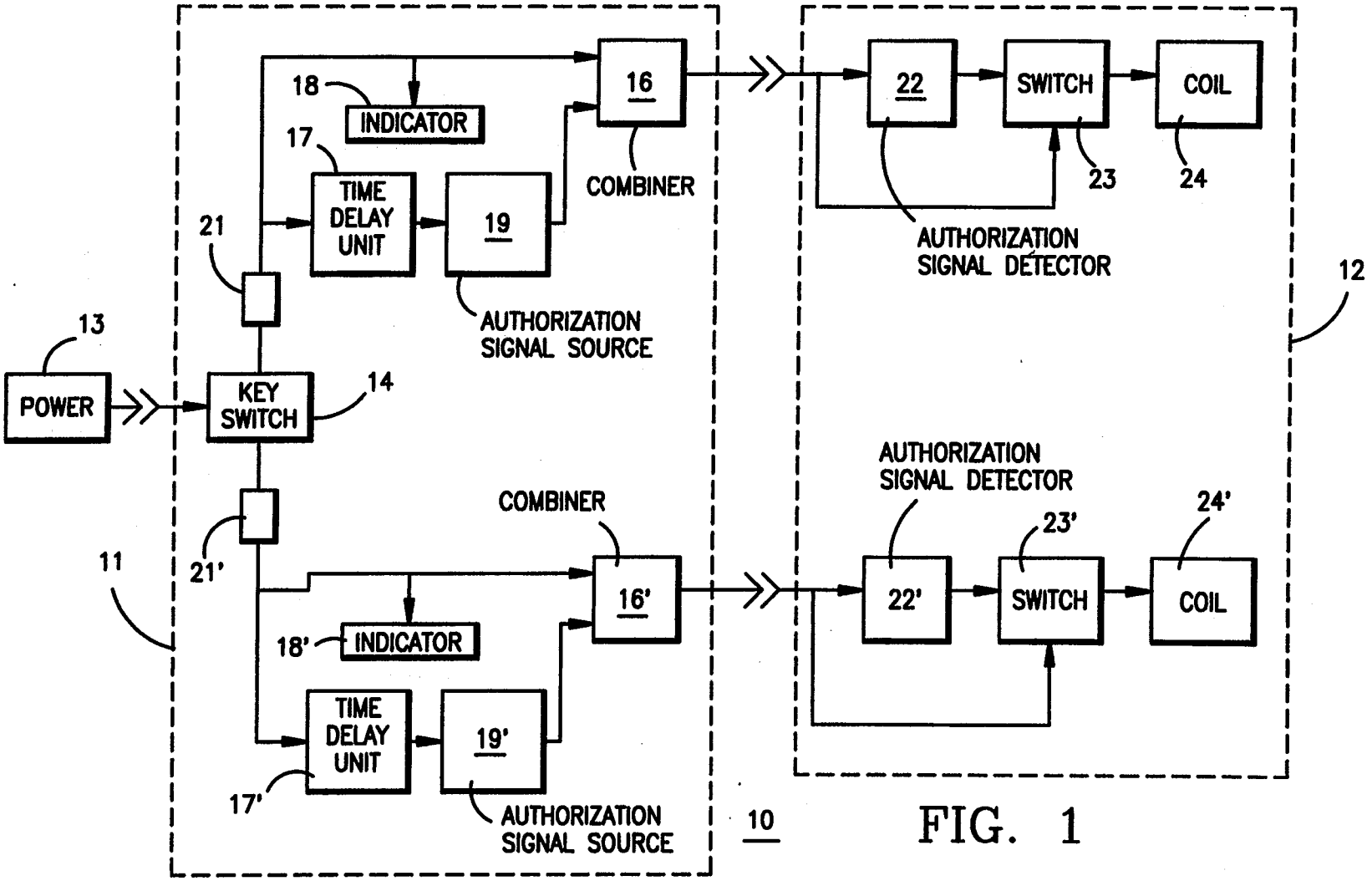
FIG. 1 comprises a block diagram of the electronic control system in accordance with the invention.
Figure 4:
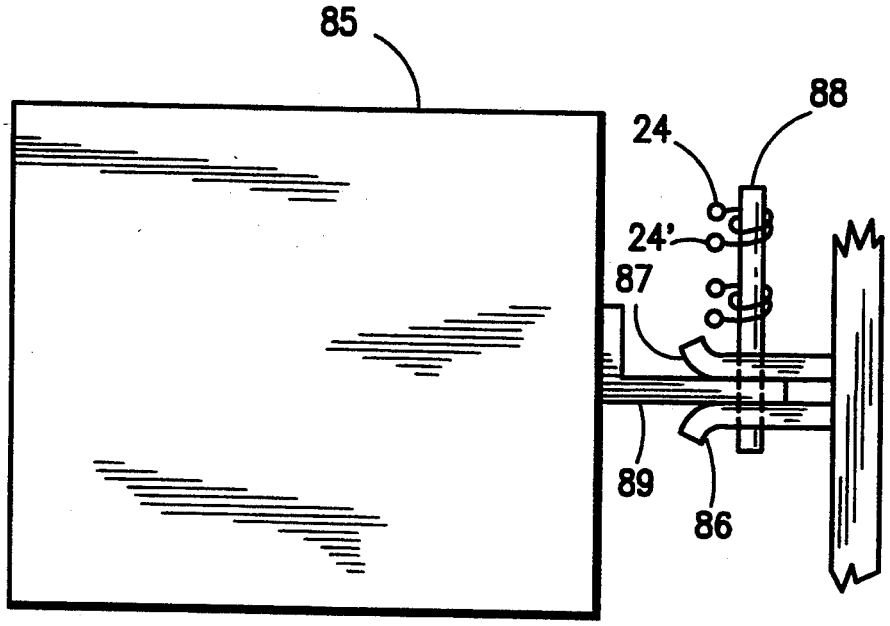
FIGS. 4 and 5, respectively, show a drawer with a solenoid pin in first and second positions.
Figure 5:
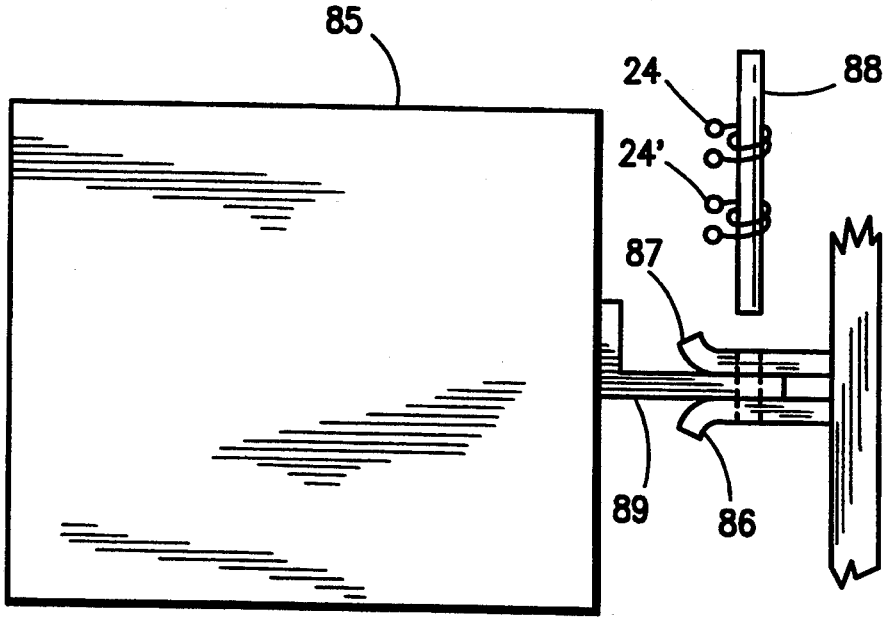

Referring now to the drawings, and in particular to FIG. 1, the electronic control system can be seen as generally depicted by the reference numeral 10. The system 10 operates in conjunction with a locked drawer 85, as appears in FIGS. 4 and 5. The drawer 85 includes a bracket 89 having a hole disposed therethrough, which bracket 89 can slide between a pair of plates 86 and 87 that also have a hole disposed therethrough. A solenoid pin 88 can pass through all of these holes when disposed in a first position, as depicted in FIG. 4, and can be retracted from the holes when disposed in a second position, as depicted in FIG. 5. This position of the pin 88 is controlled by selective energization of two electric coils 24 and 24', as explained in further detail hereinafter.

The various components that comprise the electronic control system 10 are segregated as between a first location 12 and a second location 11. These two locations are operationally remote from one another. For example, the first location could be a controlled access office, and the second location could be an open access car wash bay. "Operationally remote" therefore refers both to locations that differ from one another with respect to ease of access, and also to areas that differ from one another with respect to purpose of use.

At the second location 11, AC power 13 is coupled to the rest of the system through an operator controlled switch 14. In this particular embodiment, the operator controlled switch 14 constitutes a key switch that, when appropriately manipulated by the operator using the correct key, will close a switch to couple the power 13 to the rest of the system.

The switch 14 couples to two identical and redundant signal paths. The switch 14 connects to both a combiner 16 and a time delay unit 17. In this particular embodiment, the switch 14 also connects to an indicator 18 that provides a visual indication to the operator of proper and expected operation of the system 10.

The time delay unit 17 controls the activation of an authorization signal source 19. The latter provides a signal having predetermined characteristics to the combiner 16, and the, combiner 16 combines this authorization signal with a power signal to the first location 12. The predetermined characteristic can be anything from a fixed frequency signal to an encrypted digital message. The combiner combines this signal with the power signal in any of a variety of known ways, including by summation techniques or by modulation techniques.

In this particular embodiment, a fuse 21 has also been provided at the second location. Should an overcurrent condition develop in either signal path to the first location 12, the fuse in the affected path will break, thereby protecting the remainder of the path circuitry, and further preventing the improperly operating path from interfering with the otherwise proper operation of the remaining path.

The switch 14 is also connected to another combiner 16' and another time delay unit 17'. The switch 14 also connects to an indicator 18' that provides a redundant visual indication to the operator of proper and expected operation of the system 10. The time delay unit 17' controls deactivation of another authorization signal source 19'. The latter provides a signal having predetermined characteristics to the combiner 16', and the combiner 16' combines this authorization signal with a power signal to the first location 12. The combiner 16' combines or superimposes the signal with the power signal in any of a variety of known ways, including by summation techniques or by modulation techniques. Furthermore, a fuse 21' is also provided such that any developed overcurrent condition along the signal path to the first location 12 will cause the fuse 21' to break and prevent improper operation.

At the first location 12, a authorization signal detector 22 receives the combined signal output from the second location 11, and detects the presence of the authorization signal. The authorization signal detector 22 then enables a switch 23, which, in turn, provides power to the electric coil 24 associated therewith.

So configured, one electric coil will be controlled by one signal path, and the remaining electric coil will be controlled by the remaining signal path. Since either coil alone can operate the unlocking mechanism, this provides for complete redundancy of the unlocking mechanism. Should either path develop a problem, the remaining path will continue to provide reliable unlocking service. In addition, the indicator 18 will provide a visual indication to the operator that each path is operating properly. When either path fails to operate properly, the indicator will so indicate, and provide the operator with the opportunity to correct the path in question, and thereby restore the fully redundant operation of the system 10.

Also at the first location 12 there is another authorization signal detector 22' which receives the combines signal output from the combiner 16', and detects the presence of the authorization signal. The authorization signal detector 22' then enables a switch 23' which, in turn, provides power to the electric coil 24' associated therewith. In this fashion, since either coil 24, 24' alone can operate the unlocking mechanism, complete redundancy of the unlocking mechanism provides a reliability should either path develop a problem and, obviously, a failure along either path will be indicated by the indicator 18, 18' associated therewith.

Other elements and advantages of the invention will be made clear below in a more detailed explanation of this embodiment.

Figure 2:
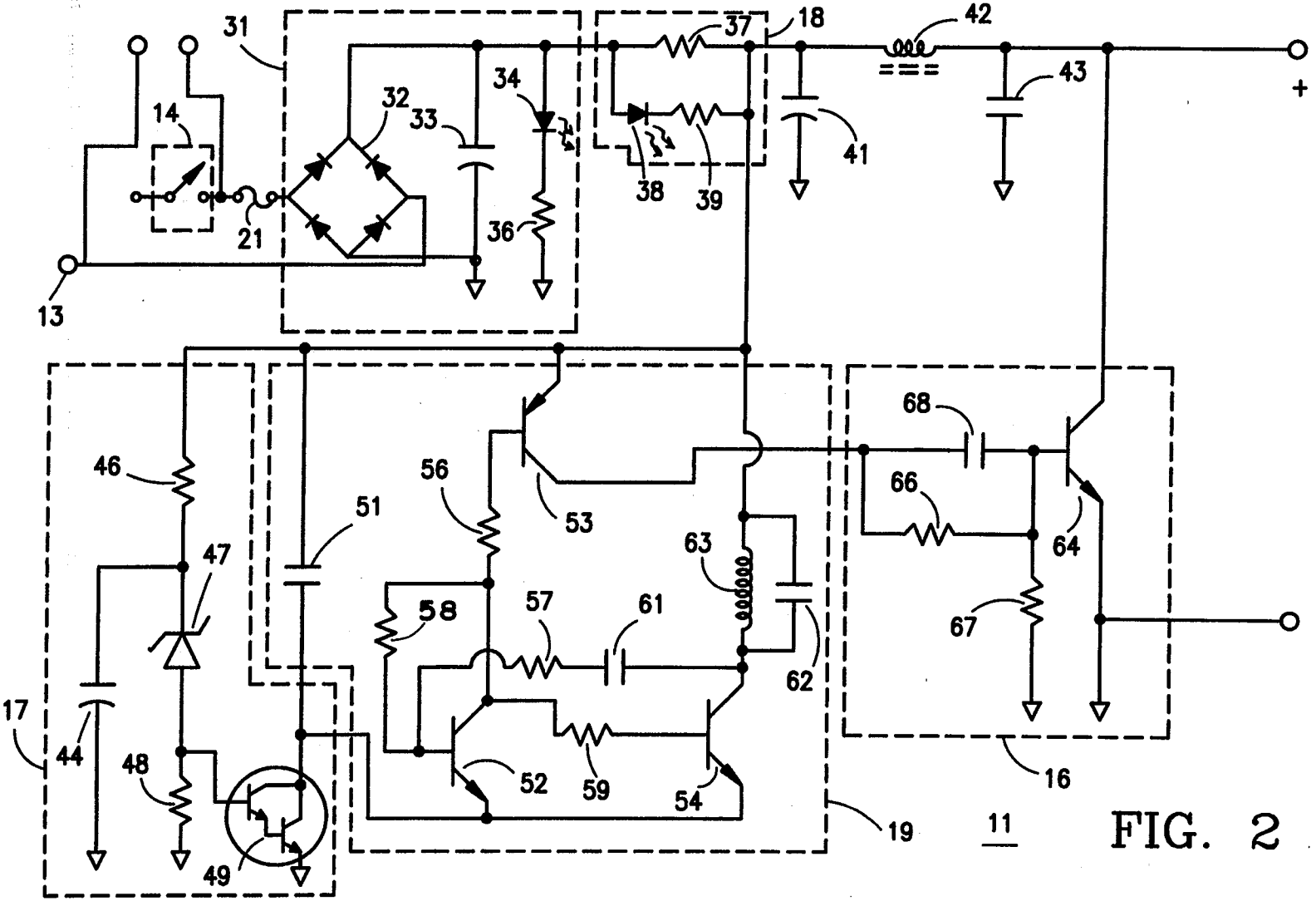
FIG. 2 comprises a schematic diagram of those portions of the electronic control system that are located at the second location in this embodiment.

Referring now to FIG. 2, those elements of the system 10 that reside at the second location 11 will be described in more detail. The switch 14 couples between the power 13 and a fuse 21 to a rectifier circuit 31. The rectifier circuit 31 includes a bridge 32 and a 100 microfarad capacitor 33. The rectifier circuit 31 also includes a pilot light, comprised, in this embodiment, of an LFD 34 and a 1000k ohm current limiting resistor 36. The pilot light, of course, provides a visual indication that the switch 14 has been closed and that the rectifier circuit 31 is supplying power to the rest of the system 10.

The output of the rectifier circuit 31 couples to an indicator 18. In this embodiment, the indicator 18 comprises a 2 ohm current sense resistor 37 that connects in parallel with an LED 38 and a 100 ohm current limiting resistor 39. So configured, when the electric coil associated with this particular path draws current, the indicator 18 will so indicate.

The indicator 18 couples to a high impedance resonant output circuit that includes a 100 microfarad capacitor 41, a 1 microHenry inductor 42, and a 0.01 microfarad capacitor 43 coupled as depicted. The output circuit itself then couples to the first location 12.

The time delay unit 17 couples to the output of the indicator 18, and includes a 100 picofarad capacitor 44, a 100k ohm resistor 46, a 10 volt Zener diode 47, a second 100k ohm resistor 48, and a Darlington configured transistor pair 49 (provided here through use of an MPSA14), all configured as depicted. So configured, upon application of power, the capacitor 44 charges through the first resistor 46 for about 10 seconds, until the voltage thereacross reaches about 11.4 volts. Upon reaching this level, the transistor pair 49 switches on and the Zener diode 47 begins to conduct. The transistor pair 49 then provides power to the authorization signal source 19.

The authorization signal source 19 includes a 0.1 microfarad capacitor 51, a first transistor 52 (provided for here through use of a 2N2222A), a second transistor 53 (provided for here, through use of a 2N2907A), a third transistor 54 (provided for here through use of another 2N2222A), a first and second 10k resistor 56 and 57, a 1M ohm resistor 58, a 200k ohm resistor 59, a first and second 0.01 microfarad capacitor 61 and 62, and a 1 microHenry inductor 63, all interconnected as depicted. So configured, the inductor 63 and associated capacitor 62 form an LC resonant oscillator. The first transistor 52 provides a pulsed signal at its collector, and drives the second transistor 53. The latter constitutes the output and connects to the combiner 16.

The combiner 16 includes a transistor 64 (provided for here through use of a 2N2222A), two 20k ohm resistors 66 and 67, and a 0.0047 microfarad capacitor 68, all coupled as depicted. So configured, the combiner 16 imposes a predetermined pulse signal upon the power supply signal flowing from the output inductor 42 to the first location 12.

Figure 3:
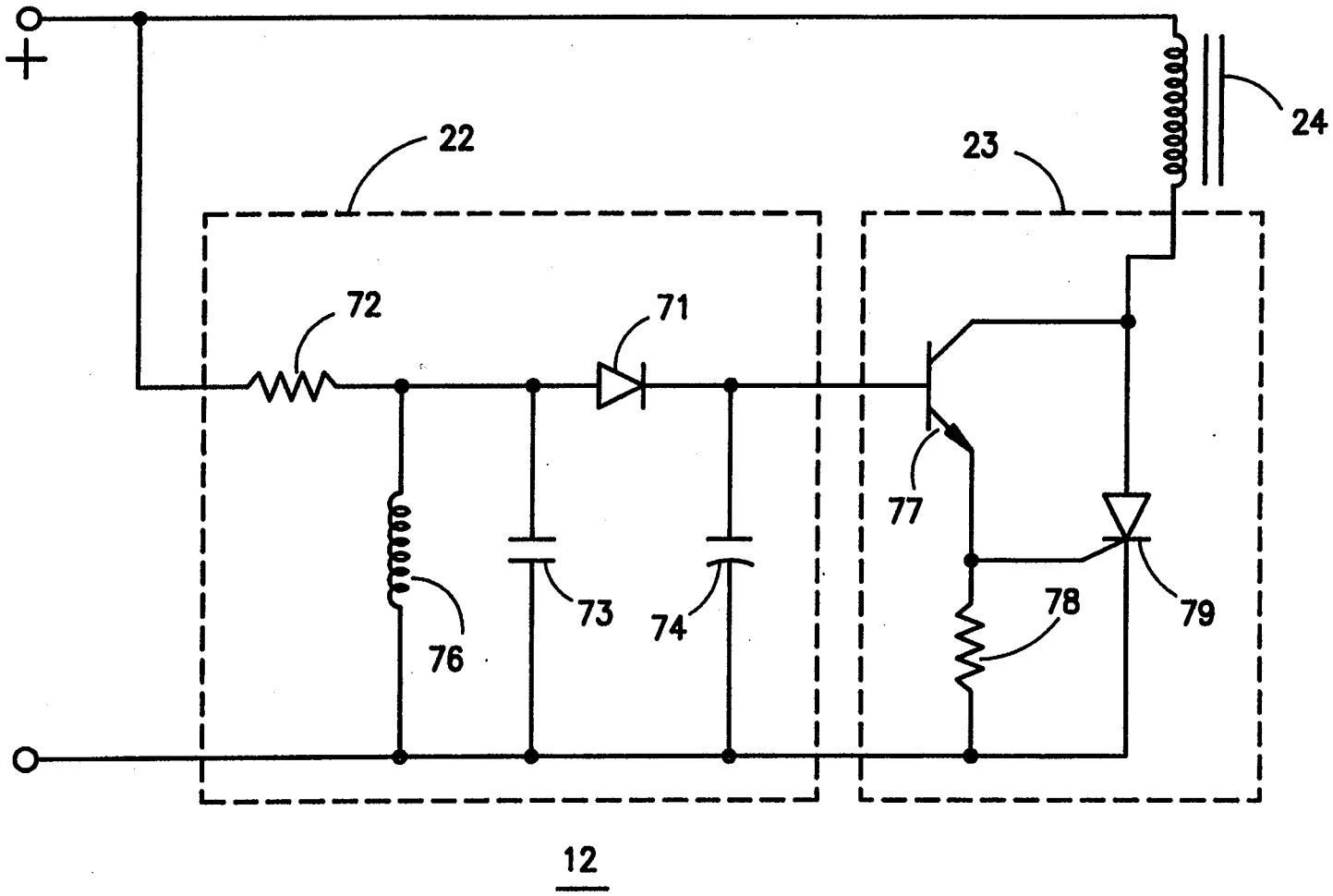
FIG. 3 comprises a schematic diagram of those portions of the electronic control system that are located at the first location in this embodiment.

Referring now to FIG. 3, a more detailed description of the elements comprising the system components at the first location 12 will be provided.

The combined authorization signal and power signal is received at the first location 12 by the authorization signal detector 22 (with the power signal also being provided to the solenoid coil 24 as well). The authorization signal detector 22 includes a 1N4148 diode 71, a 3k ohm resistor 72, a 0.01 microfarad capacitor 73, a 47 microfarad capacitor 74, and a 1 microHenry inductor 76, all interconnected as depicted. So configured, the inductor 76, resistor 72, and the first capacitor 73 form a resonant filter that is, in this instance, tuned to a frequency equal to:

$$\frac{1}{2\pi\sqrt{LC}}.$$

The diode 71 and remaining capacitor 74 act as a peak detector, and produce a DC signal that is proportional to the selected input frequency voltage magnitude. The resistor 72 and second capacitor 74 also serve to filter out noise that is similar to the authorization signal but which is less than a predetermined value.

The switch 23 includes a transistor 77 (provided for here through use of a 2N2222A), a 3k ohm resistor 78, and a silicon controlled rectifier 79. The latter is coupled in series with the electric coil 24, and hence, when the SCR 79 is active, the coil 24 will be energized and unlock the drawer. The transistor 77 serves as a buffer and amplifier for the signal being issued by the authorization signal detector 22. The switch 23 will energize the coil 24 when the voltage across the output capacitor 74 of the authorization signal detector 22 charges to about 1.3 volts.

So configured, a number of important benefits result. First, the operator interface mechanism that initiates the unlocking process is remotely located with respect to the locked drawer itself. Therefore, persons seeking to make unauthorized access to the locked drawer will not have ready access to the interface mechanism itself. Second, a potential disadvantage of remotely locating the operator interface is overcome by providing a time delay between the time the operator initiates the process and the time the coils are actually energized and the drawer is unlocked. This prevents an unauthorized person from gaining access to the drawer in the period of time between when the operator initiates the unlocking process and when the operator actually arrives at the location of the locked drawer itself. Third, the enabling circuitry subsequent to the operator switch is completely parallel and redundant, thereby assuring high reliability and a substantially reduced likelihood that a system failure will result in an inability to access the locked drawer in the absence of extraordinary measures. Fourth, the circuit operation indicators provide the operator with warning when a circuit failure has occurred, thereby allowing repairs to be made before subsequent failures can occur that would render the drawer un-openable. Fifth, the system requires an authorization signal in addition to the presence of power before energization of the coils will occur, thereby further ensuring the security of the system.

What is claimed is:

1. An electronic control system for use with a drawer that is located in a first location and that is locked in a closed position by at least one pin disposed in a first position and that is unlocked by moving the pin to a second position, the electronic control system comprising:

A) a first electric coil that is independently capable of moving the at least one pin to the second position, and being operably coupled to the at least one pin, for causing the at least one pin to move to the second position when energized; and B) a second electric coil that is independently capable of moving the at least one pin to the second position, and being operably coupled to the at least one pin, for causing the at least one pin to move to the second position when energized; and C) coil activation means coupled to both the first and second electric coils for causing both coils to simultaneously become energized, wherein the coil activation means includes:

authorization signal source means located in a second location that is operationally remote from the first location for providing an authorization signal;

means for supplying a power signal;

combining means located at the second location and being operably coupled to the authorization signal source means and the power signal supplying means for superimposing the authorization signal with the power signal;

authorization signal detecting means located at the first location for receiving and detecting the presence of the authorization signal in combination with said power signal, and for supplying said power signal to energize the first and second coils in response thereto.

2. The electronic control system of claim 1, wherein the coil activation means further includes initiation means for initiating activity of the coil activation means that leads to energization of the first and second electric coils, which initiation means are located in the second location.

3. The electronic control system of claim 2, wherein the coil activation means further includes time delay means operably coupled to the initiation means for providing an initial delay in responding to the initiation means, such that an operator will be provided with a period of time within which the operator can move from the second location to the first location before the first and second electric coils are energized.

4. The electronic control system of claim 1, wherein the authorization signal comprises a periodic pulsed signal.

5. The electronic control system of claim 4, wherein the combining means imposes the periodic pulsed signal onto the power signal.

6. The electronic control system of claim 1, wherein the coil activation means includes indicator means operably coupled to sense a flow of power to the first and second electric coils and to provide a visual indication when such power flow is sensed.

7. An electronic control system for use with a drawer that is located in a first location, and that is locked in a closed position by at least one pin disposed in a first position and that is unlocked by moving the pin to a second position, the electronic control system comprising:

A) a first electric coil that is independently capable of moving the at least one pin to the second position, and being operably coupled to the at least one pin, for causing the at least one pin to move to the second position when energized; and B) a second electric coil that is independently capable of moving the at least one pin to the second position, and being operably coupled to the at least one pin, for causing the at least one pin to move to the second position when energized;

C) a first switch operably coupled to the first electric coil;

D) a second switch operably coupled to the second electric coil;

E) a first authorization signal detector operably coupled to the first switch, for causing the first switch to provide power to the first electric coil when the first authorization signal detector has been provided with both:

i) a first power signal; and ii) a first authorization signal;

F) a second authorization signal detector operably coupled to the second switch, for causing the second switch to provide power to the second electric coil when the second authorization signal detector has been provided with both:

i) a second power signal; and ii) a second authorization signal; at a second location:

G) an operator controlled switch;

H) first time delay means operably coupled to the operator controlled switch for delaying a response to the operator controlled switch;

I) second time delay means operably coupled to the operator controlled switch for delaying a response to the operator controlled switch;

J) first authorization signal source means operably coupled to the first time delay means and the operator controlled switch for providing the first authorization signal after the delay provided by the first time delay means;

K) second authorization signal source means operably coupled to the second time delay means and the operator controlled switch for providing the second authorization signal after the delay provided by the second time delay means;

L) first combiner means operably coupled to the first authorization signal source means and the operator controlled switch for combining the first authorization signal with the first power signal to provide a combined signal to the first authorization signal detector means;

M) second combiner means operably coupled to the second authorization signal source means and the operator controlled switch for combining the second authorization signal with the second power signal to provide a combined signal to the second authorization signal detector means;

such that upon actuation of the operator controlled switch, both of the first and second electronic coils will be caused, after an initial predetermined delay, to become energized by completely parallel and redundant paths.

* * * * *